US012246760B2

(12) United States Patent
Heinzl

(10) Patent No.: US 12,246,760 B2
(45) Date of Patent: Mar. 11, 2025

(54) ANTI-CLIMBER DEVICE FOR A RAIL VEHICLE

(71) Applicant: Siemens Mobility Austria GmbH, Vienna (AT)

(72) Inventor: Philipp Heinzl, Enzenreith (AT)

(73) Assignee: Siemens Mobility Austria GmbH, Vienna (AT)

( * ) Notice: Subject to any disclaimer, the term of this patent is extended or adjusted under 35 U.S.C. 154(b) by 888 days.

(21) Appl. No.: 17/296,817

(22) PCT Filed: Nov. 18, 2019

(86) PCT No.: PCT/EP2019/081641
§ 371 (c)(1),
(2) Date: May 25, 2021

(87) PCT Pub. No.: WO2020/109054
PCT Pub. Date: Jun. 4, 2020

(65) Prior Publication Data

US 2022/0001905 A1 Jan. 6, 2022

(30) Foreign Application Priority Data

Nov. 26, 2018 (AT) ..... A 51040/2018

(51) Int. Cl.
*B61F 19/04* (2006.01)
*B61D 15/06* (2006.01)

(52) U.S. Cl.
CPC ..... *B61F 19/04* (2013.01); *B61D 15/06* (2013.01)

(58) Field of Classification Search
CPC ..... B61F 19/04; B61D 15/06
See application file for complete search history.

(56) References Cited

U.S. PATENT DOCUMENTS 72,891 A 12/1867 Pennock
4,576,294 A 3/1986 Forster
6,460,667 B1 * 10/2002 Bruck ..... F16F 7/121 188/371
6,561,105 B2 5/2003 Godin et al.
(Continued)

FOREIGN PATENT DOCUMENTS

CN 201923167 U 8/2011
CN 103192845 7/2013
(Continued)

OTHER PUBLICATIONS

Office Action dated Sep. 16, 2021 issued in Russian Patent Application No. 2021114889/09.
(Continued)

*Primary Examiner* — Robert J McCarry, Jr.
(74) *Attorney, Agent, or Firm* — Cozen O'Connor

(57) ABSTRACT

An anti-climber device for a rail vehicle includes an impact plate having a plurality of protruding formations, wherein the profile of the formations when the anti-climber device is in the installed position is formed as a polygonal curve with a repeating sequence of sections that rise and fall relative to the horizontal, where the extent of the formations above the surface of the impact plate follows a polygonal curve with a repeating sequence of rising and falling sections.

8 Claims, 2 Drawing Sheets

(56) References Cited

U.S. PATENT DOCUMENTS

| | | | | |
|---|---|---|---|---|
| 7,866,716 | B2 * | 1/2011 | Perucca | B60R 19/18 293/133 |
| 8,646,392 | B2 | 2/2014 | Graf et al. | |
| 8,905,444 | B2 * | 12/2014 | Zannier | B60R 19/34 293/133 |
| D815,984 | S * | 4/2018 | Leutenegger | D12/42 |
| 10,065,587 | B2 * | 9/2018 | Martini | B60R 19/03 |
| 10,279,822 | B2 | 5/2019 | Gao | |
| 2002/0073887 | A1 | 6/2002 | Godin et al. | |
| 2010/0218701 | A1 * | 9/2010 | Graf | B61D 15/06 105/392.5 |
| 2012/0325108 | A1 | 12/2012 | Graf et al. | |
| 2015/0274102 | A1 * | 10/2015 | Ghannam | B60R 19/26 293/132 |
| 2016/0347333 | A1 * | 12/2016 | Lenzi | B61G 11/18 |
| 2018/0208219 | A1 | 7/2018 | Gao | |
| 2020/0130715 | A1 * | 4/2020 | Ding | B61D 15/06 |

FOREIGN PATENT DOCUMENTS

| | | | |
|---|---|---|---|
| CN | 203766810 | | 8/2014 |
| CN | 203766810 | U | 8/2014 |
| CN | 204915710 | U | 12/2015 |
| CN | 105620505 | B | 1/2018 |
| DE | 3228941 | | 2/1984 |
| EP | 1927524 | | 6/2008 |
| EP | 2130739 | | 12/2009 |
| RU | 2231462 | C2 | 6/2004 |
| RU | 2554920 | C2 | 6/2015 |
| RU | 2667998 | C1 | 9/2018 |

OTHER PUBLICATIONS

PCT International Search report dated Feb. 26, 2021 based on PCT/EP2019/081641 filed Nov. 18, 2019.

* cited by examiner

ANTI-CLIMBER DEVICE FOR A RAIL VEHICLE

CROSS-REFERENCE TO RELATED APPLICATIONS

This is a U.S. national stage of application No. PCT/EP2019/081641 filed 18 Nov. 2019. Priority is claimed on Austrian Application No. A51040/2018 filed 26 Nov. 2018, the content of which is incorporated herein by reference in its entirety.

BACKGROUND OF THE INVENTION

1. Field of the Invention

The invention relates to an anti-climber device for a rail vehicle.

2. Description of the Related Art

In head-on collisions between rail vehicles, the collision forces are to be introduced into the assemblies which are designed to absorb and convert the collision energy into deformation energy. These are typical y embodied as so-called energy-consuming elements which can be deformed over a specific deformation path and have a force-travel characteristic specially adapted for this purpose. If the energy absorption capacity of such elements is exhausted, further collision energy is introduced into the vehicle structure. Here, it should be noted that the underframe of a rail vehicle has a much more rigid structure than all the other assemblies, in particular the side walls, end walls and the roof. During the course of a collision between two rail vehicles, one of the rail vehicles can move in such a way that its underframe is pushed over the underframe of the other vehicle (i.e. it climbs up), thus loading the much less rigid region above the underframe with collision energy. This can easily happen in the case of a vertical offset of the colliding vehicles and potentially leads to catastrophic consequences of an accident since the passenger compartment of one of the vehicles can be destroyed over a large area. To prevent this effect, so-called anti-climber devices are used to hold the vehicles in their vertical position relative to one another in the event of a collision. These anti-climber devices are typically provided at those points of the vehicles which are the first to meet another vehicle and comprise a plate with a horizontally oriented rib structure. In the event of a collision, these rib structures of the colliding anti-climber devices engage with one another and form a positive connection which prevents the anti-climber devices from sliding vertically relative to one another. However, if the colliding anti-climber devices are horizontally displaced relative to one another, i.e. if the anti-climber devices only partially overlap in the lateral direction, the resulting torques can twist the mountings of the anti-climber devices such that the anti-climber devices slide laterally against one another and hence subsequently become ineffective. This can in particular occur if the surface of the anti-climber device which is embodied with a rib structure has relatively small dimensions and a horizontal offset has a correspondingly greater effect. To remedy this deficiency, impact plates have been created which allow full-surface toothing but are only able to act with impact plates of the same type and which are expensive to manufacture.

PRESENTATION OF THE INVENTION

The invention is therefore based on the object of providing an anti-climber device which prevents lateral sliding even in the case of a horizontally offset collision with another anti-climber device.

The object is achieved by an anti-climber device with the features of claim 1. Advantageous embodiments are the subject matter of subordinate claims.

According to the basic concept of the invention, an anti-climber device for a rail vehicle is described which comprises an impact plate having a plurality of protruding formations, wherein the profile of the formations when the anti-climber device is in the installed position is formed as a polygonal curve with a repeating sequence of rising and failing sections relative to the horizontal, and wherein the extension of the formations above the surface of the impact plate follows a polygonal curve with a repeating sequence of rising and falling sections.

As a result, it is possible to achieve the advantage of being able to ensure reliable interlocking of the formations even in the case of a laterally (horizontally) offset collision between two anti-climber devices according to the invention thus preventing the impact plates from sliding against one another.

According to the invention, an anti-climber device is constructed which comprises an impact plate with formations. Impact plates are known from the prior art that are equipped with horizontally aligned formations (ribs) when the anti-climber device is in the installed position. According to the present invention, these formations are to be embodied as a polygonal curve with a repeating sequence of rising and falling sections as a result of which, in the event of a collision with an impact plate of the same type, mutual interlocking takes place at the rising and falling sections of the formations. In this way, the impact plates cannot slide against one another and hence cannot lose their effect.

As a result of the effect of the present anti-climber device, the functions of any energy-consuming devices are also retained. The interlocking of the impact plates of the parties involved in the collision causes the energy-consuming devices to be continuously exposed to the collision force in the intended spatial direction. If, on the other hand, the impact plates were to slide against one another, an energy-consuming element located behind them would no longer be able to provide any defined resistance.

The anti-climber device according to the invention comprises an impact plate, which can, for example, have a rectangular or square design and which serves to attach the anti-climber device to the vehicle structure behind it. This can, for example, take place by means of a welded connection or also detachably by means of a screw connection.

The impact plate is equipped with a plurality of formations which extend from the impact plate in the opposite direction to the vehicle structure and which have a rib-like design, Herein, the formations follow a profile with alternating rising and falling sections. Hence, this profile appears substantially sawtooth-like, optionally also with inserted horizontal sections. These optional horizontal sections should be significantly shorter than the rising or falling sections.

The height of the ribs, i.e. the extension of the formations above the surface of the impact plate, follows a polygonal curve with a repeating sequence of rising and falling sections. Hence, the height of the ribs is variable over its profile and follows a sawtooth-like profile.

A plurality of formations are to be provided on the impact plate, which, when the impact plate is in the installed position, are aligned horizontally. Herein, the sequence of the rising and falling sections should preferably be aligned in such a way that the minima and maxima of the profile of all the formations are in each case arranged on a line which is arranged vertically in the installed position.

In this way, according to a preferred embodiment, the formations can in each case consist of identical profiles so that, when viewed from the front, all the formations are parallel to one another and equally spaced apart A further preferred embodiment provides that the profile of two adjacent formations is a mirror-image of the other.

The anti-climber device can be made of all metallic materials that are commonly used for anti-climber devices. For this purpose, it is in particular possible to use steel and aluminum alloys.

An anti-climber device according to the invention can be used at all positions of a rail vehicle front, in particular at those positions which, in the event of a collision, are the first to come into contact with a party involved in the collision. Arrangement in the center of the vehicle as used in some vehicles is also possible.

A further advantage of the present anti-climber device consists in the fact that it is also effective on collision with conventional anti-climber devices equipped with rectilinear formations with full protection against vertical climbing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further advantageous refinements and aspects of the invention are the subject matter of the dependent claims and of the exemplary embodiments, described below, of the invention. The invention is explained in more detail below on the basis of preferred embodiments with reference to the attached figures, in which:

DETAILED DESCRIPTION OF THE EXEMPLARY EMBODIMENTS

Figure 1:
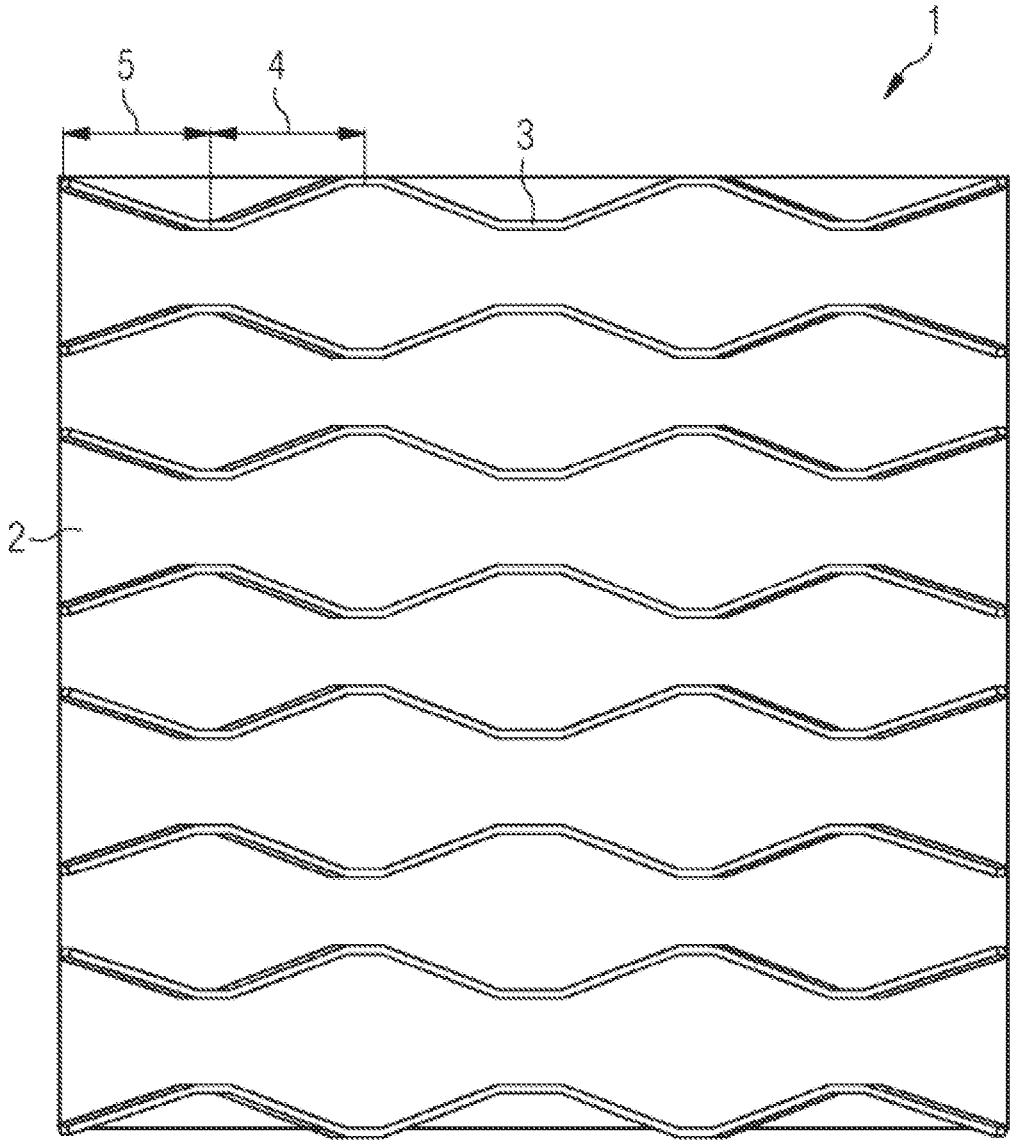
FIG. 1 shows a front view of an anti-climber device in accordance with the inventing.

FIG. 1 shows by way of example and schematically a front view of an anti-climber device. In this exemplary embodiment, an anti-climber device 1 has a square configuration and comprises an impact plate 2 and a plurality of formations 3 protruding from the impact plate 2, the profile of which each follows a polygonal curve of straight sections. Herein, alternately rising 4 and falling 5 sections are provided in a formation 3. In the exemplary illustrated embodiment, eight formations 3 are arranged such that the shape of the polygonal curve of two adjacent formations 3 is a mirror image of the other. Herein, short horizontal sections each connect the rising 4 and falling 5 sections. The anti-climber device 1 is depicted in its position of normal use in which the formations 3 are arranged horizontally. In this alignment, the anti-climber device 1 is to be arranged on a vehicle structure, for example, a corner pillar or a protruding energy-consuming element. Corresponding assemblies of a rail vehicle are not depicted in FIG. 1.

Figure 2:
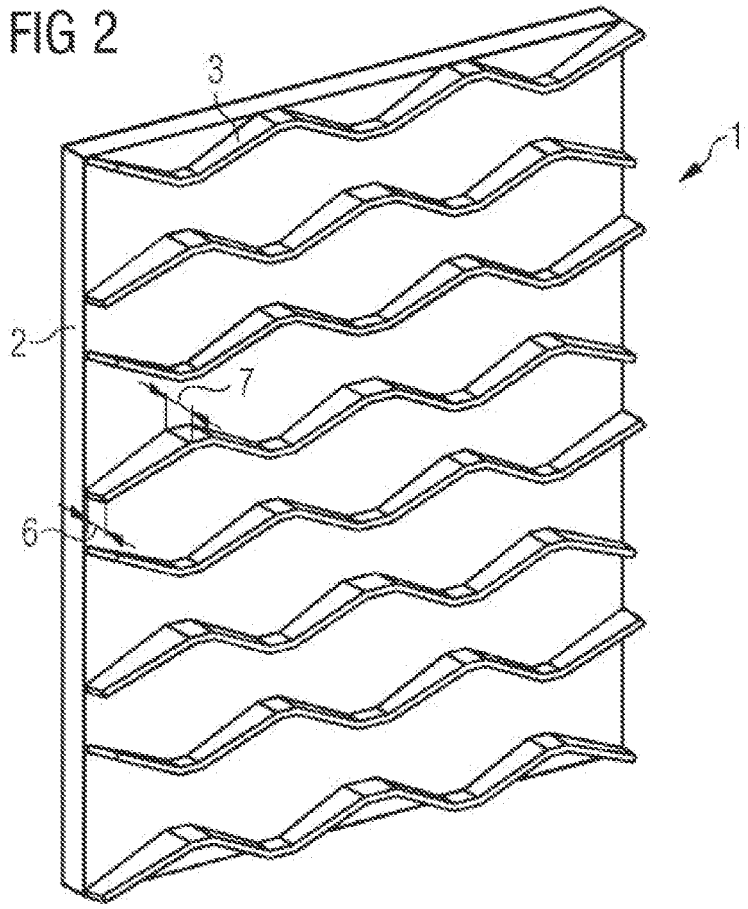
FIG. 2 shows an oblique view of the anti-climber device of FIG. 1.

FIG. 2 shows by way of example and schematically an oblique view of an anti-climber device. This depicts the anti-climber device 1 from FIG. 1, where the shape of the formations 3 is particularly clearly visible in this view. Herein, the profile of the extension (height) above the impact plate 2 of each formation 3 can be identified. This extension varies between a minimum 6 above the impact plate 2 and a maximum 7 above the impact plate.

Figure 3:
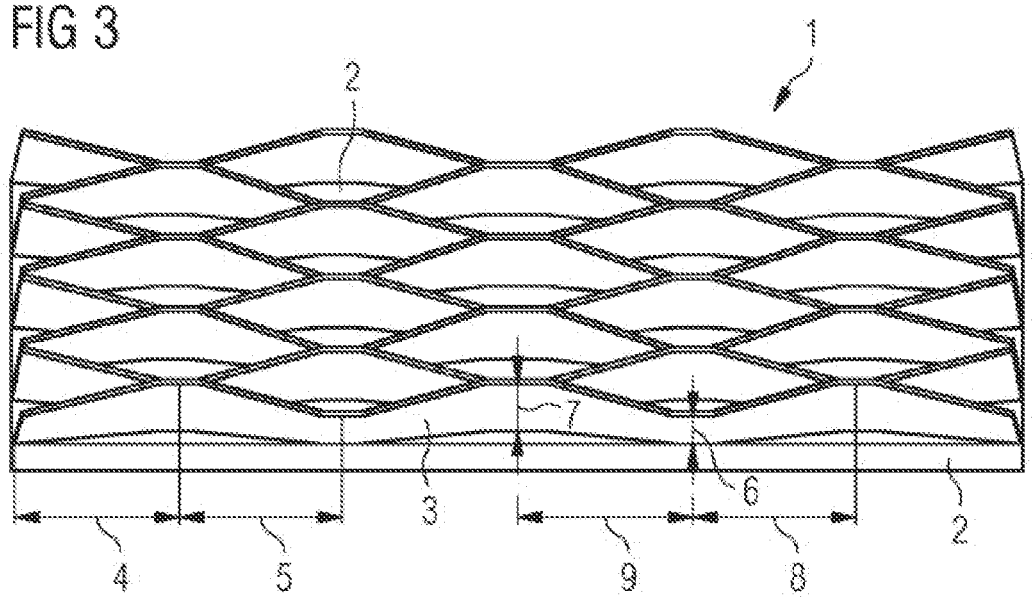
FIG. 3 shows an oblique view of the anti-climber device of FIG. 1 from below.

FIG. 3 shows by way of example and schematically an oblique view of an anti-climber device from below. This depicts the anti-climber device 1 from FIGS. 1 and 2, wherein in particular the profile of the extension above the impact plate 2 of the formations 3 is clearly visible. In each case, a rising 8 or falling 9 section of the extension is provided between the minima 6 and maxima 7.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An anti-climber device of a rail vehicle comprising:

an impact plate having a plurality of physically spaced apart protruding formations, each of the formations being individually formed and protruding from the impact plate;

wherein a profile of the protruding formations when the anti-climber device of the rail vehicle is in an installed position is formed as a polygonal curve with a repeating sequence of rising and falling sections relative to a horizontal plane; and wherein an extension of the plurality of protruding formations above a surface of the impact plate follows a polygonal curve with a repeating sequence of rising and falling sections.

2. The anti-climber device of the rail vehicle as claimed in claim 1, wherein a minima and maxima of a profile of all of the plurality of protruding formations are each arranged on a vertical line when the anti-climber device is in the installed position.

3. The anti-climber device of the rail vehicle as claimed in claim 2, wherein a profile of two adjacent protruding formations of the plurality of protruding formations is a mirror image of each other.

4. The anti-climber device of the rail vehicle as claimed in claim 3, wherein the extension of the formations above the surface of the impact plate of two adjacent formations of the plurality of protruding formations is a mirror image of each other.

5. The anti-climber device of the rail vehicle as claimed in claim 2, wherein the profile of two adjacent protruding formations of the plurality of protruding formations is parallel to each other.

6. The anti-climber device of the rail vehicle as claimed in claim 5, wherein the extension of the formations above the surface of the impact plate of two adjacent formations of the plurality of protruding formations is a mirror image of each other.

7. The anti-climber device of the rail vehicle as claimed in claim 2, wherein the extension of the formations above the surface of the impact plate of two adjacent formations of the plurality of protruding formations is a mirror image of each other.

8. The anti-climber device of the rail vehicle as claimed in claim 1, wherein the extension of the formations above the surface of the impact plate of two adjacent formations of the plurality of protruding formations is a mirror image of each other.

* * * * *